US006145973A

United States Patent [19]

Wu et al.

[11] Patent Number: 6,145,973

[45] Date of Patent: Nov. 14, 2000

[54] INK-JET CARTRIDGE

[75] Inventors: Ji-Chen Wu; Hsien-Shu Tsai; Dong-Sang Chiang, all of Hsinchu, Taiwan

[73] Assignee: WiserTek International Corp., Taiwan

[21] Appl. No.: 09/395,370

[22] Filed: Sep. 14, 1999

[51] Int. Cl.[7] ..... B41J 2/175

[52] U.S. Cl. ..... 347/86

[58] Field of Search ..... 347/84, 85, 86, 347/87

[56] References Cited

U.S. PATENT DOCUMENTS

| | | | |
|---|---|---|---|
| 5,409,134 | 4/1995 | Cowger et al. | 222/1 |
| 5,988,803 | 11/1999 | Complin et al. | 347/86 |
| 6,010,212 | 1/2000 | Yamashita et al. | 347/86 |

*Primary Examiner*—N. Le
*Assistant Examiner*—Anh T. N. Vo
*Attorney, Agent, or Firm*—Birch, Stewart, Kolash & Birch, LLP

[57] ABSTRACT

The present invention provides any ink jet pen an apparatus for storing and printing ink, wherein a valve is connected between the ink reservoir and the ink chamber for controlling the ink flow between the ink reservoir and the ink chamber and adjusting the air pressure in the ink chamber to keep the pressure in the ink chamber within the allowed range as the ink gradually gets depleted or the environmental pressure changes. The valve having a plunger and a plunger chamber, wherein the plunger chamber is connected to the atmosphere via an atmospheric opening and connected to the ink chamber via a feedback opening which adjusts the pressure in the ink chamber to move the plunger. When a difference between the atmospheric pressure and inner pressure of the ink chamber develops, the plunger will be pushed by the pressure of the atmosphere or the ink chamber to determine whether the ink reservoir is connected to the ink chamber and to adjust the ink chamber inner pressure. Therefore, the cartridge can provide a proper ink supply and thorough ink usage and leakage prevention.

20 Claims, 9 Drawing Sheets

INK-JET CARTRIDGE

BACKGROUND OF THE INVENTION

1. Field of the Invention

The present invention relates to an ink jet cartridge and, in particular, to a valve design applicable to an ink jet cartridge for controlling the ink flow between the ink reservoir and the ink chamber and adjusting the air pressure in the ink chamber to keep the pressure in the ink chamber within the allowed range as the ink gradually gets depleted or the environmental pressure changes.

2. Related Art

In ink jet printing, it is common to use ink control methods such as the heat bubble or piezoelectric wave ink jet cartridge to control the ink output. The print head of the heat bubble ink jet cartridge contains a thin film resistor which can instantaneously vaporize the tiny ink droplet after being heated and the vaporized ink droplet rapidly expand to pass the ejection nozzle of the print head and print on the paper. Although it can effectively get ink from the ink reservoir of the ink jet cartridge and spray ink, yet it still requires an extra control mechanism to prevent it from leaking while it is not working.

This control mechanism usually prevents the print head from leaking by providing the print head with a slight back pressure due to the partial vacuum in the ink reservoir. The back pressure is expressed in positive values. Therefore, an increase in the value of the back pressure indicates a better vacuum in the reservoir.

In the design of an ink jet cartridge, one usually needs to consider the following factors:

1. The pressure between the ink reservoir and the environment has to be balanced by the adjustment of the back pressure, which, however, can not be so large that the print head can not overcome the back pressure to jet ink and provide a proper ink supply or the size of the ink droplet it spreads out changes so much to deteriorate the printing quality.
2. The back pressure in the ink reservoir has to be able to be adjusted according to the environmental pressure change and to be kept within the allowed range. For example, when the environmental pressure decreases, the back pressure has to be larger so that the ink will not leak out of the print head.
3. The operating effect of the ink reservoir also has an effect on the back pressure in the ink reservoir. For example, the continuous consumption of the ink in the ink reservoir will raise the back pressure in the ink reservoir. Eventually the large back pressure will prohibit the print head from spreading out ink if it is not properly adjusted.

Currently, the adjustment of the back pressure in the ink reservoir is achieved by a device called accumulator in the ink reservoir, which in general is an elastic air bag. This device is designed to change, via the action of the accumulator with its volume varying between its maximum and minimum, the volume of the ink reservoir and thus to adjust the back pressure.

Referring to FIG. 1, which shows the structure of the ink jet cartridge 1 that is equipped with an accumulator 20 as disclosed in the U.S. Pat. No. 5,409,134. The ink jet cartidge 1 comprises:

an ink reservoir 10, which is enclosed by a case 11;

a print head 30, which is placed at the bottom of the ink reservoir 10 and via which the ink 40 in the ink reservoir 10 can be printed on the paper;

an accumulator 20 placed within the ink reservoir 10, which comprises:

a spring 21*a*, 21*b;* an air bag 22*a*, 22*b*, which is encompassed by two thin movable plates 23, 24;

a support 25, which connects to the air bag 22*a*, 22*b* and provide a venthole 12 for the air to enter the air bag 22*a*, 22*b*.

The support 25 is installed with a wheel net 26, and the air bag 22*a*, 22*b* along with the spring 21*a*, 21*b* are fixed onto the case 11 by a positioning pin 27. In addition, a ventilating duct 28 is placed between the movable plates 23, 24 for the air to flow through the venthole 12 and enter the air bag 22*a*, 22*b*. After filling up the ink reservoir 10 with the ink 40, the ink reservoir 10 will obtain its minimal back pressure under the action of the accumulator 20 and therefore will not allow the ink 40 to leak out of the print head 30 in the stand-by state.

When printing, the ink 40 will be gradually depleted and increase the vacuum and thus the back pressure within the ink reservoir 10. At this moment, the air will flow through the ventilating duct 28 into the air bag 22*a*, 22*b* and inflate the air bag 22*a*, 22*b*, thus the space in the ink reservoir decreases and balance the back pressure increase in the ink reservoir 10.

Referring to FIG. 2. When the environmental pressure decreases (for example, in the airfreight), the spring 21*a*, 21*b* will press upon and contract the air bag 22*a*, 22*b* (the air within is then squeezed out by the external force) so that the space in the ink reservoir 10 increases. Therefore, the back pressure in the ink reservoir 10 will not decrease as the environmental pressure decreases, and the ink 40 will not leak out of the print head 30.

SUMMARY OF THE INVENTION

The present invention provides a valve of an ink jet cartridge applicable to an ink jet cartridge for controlling the ink flow between the ink reservoir and the ink chamber and adjusting the air pressure in the ink chamber to keep the pressure in the ink chamber within the allowed range as the ink gradually gets depleted or the environmental pressure changes. Thus the ink can be completely used and never leak out of the cartridge.

The valve of the ink cartridge according to the invention is connected between an ink reservoir and an ink chamber for controlling the ink flow between the ink reservoir and the ink chamber. The valve comprises:

a plunger chamber, which includes: an atmospheric opening connecting to the atmosphere, an ink inlet connecting to a orifice on the ink reservoir, an ink outlet connecting to the ink chamber, and a feedback opening connecting to the ink chamber; and a plunger, which is placed between the atmospheric opening and the feedback opening within the plunger chamber to cover the ink inlet and the ink outlet and can be moved by the pressure difference between the environment and the ink chamber to determine whether the ink reservoir and the ink chamber are connected or not; wherein the plunger further comprises a channel connecting the ink inlet and ink outlet for the ink to flow from the ink reservoir into the ink chamber.

In particular, the plunger can be of a cylindrical or cubic shape and the plunger chamber is designed according to the plunger's shape to be a passageway with a circular or square cross section. When printing, the ink reservoir supplies the ink. As a difference between the atmospheric pressure and the inner pressure of the ink chamber develops, the plunger will be pushed by either the atmospheric pressure or the inner pressure of the ink chamber to simultaneously cover the ink inlet and outlet and control the connection between the ink reservoir and the ink chamber. As to the ink supply, the ink flows from the orifice via the valve to the ink chamber, and the ink temporarily stored in the ink chamber will be used for printing by the print head.

The order of the actions of the valve according to the invention can be separated, pursuant to the action principle of the ink jet printing process, as: initial position, starting ink jet, starting ink supply, and finishing ink jet.

At the initial position, the plunger covers the orifice, the ink can not pass and the inner and outer pressures balance. While starting ink jet, the atmospheric pressure pushes the plunger so that the channel of the plunger aligns with the orifice. When starting ink supply, the ink flows from the ink reservoir into the ink chamber with the inner and outer pressures balanced. In finishing ink jet, the air in the ink chamber pushes the plunger channel away from the orifice back to the initial position to stop further ink supply and the pressure is balanced again.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

A valve of the ink jet cartridge according to the instant invention is used to control the ink flow from the ink reservoir to the ink chamber and to adjust the pressure between the ink chamber and the environment.

Embodiment 1

Figure 1:
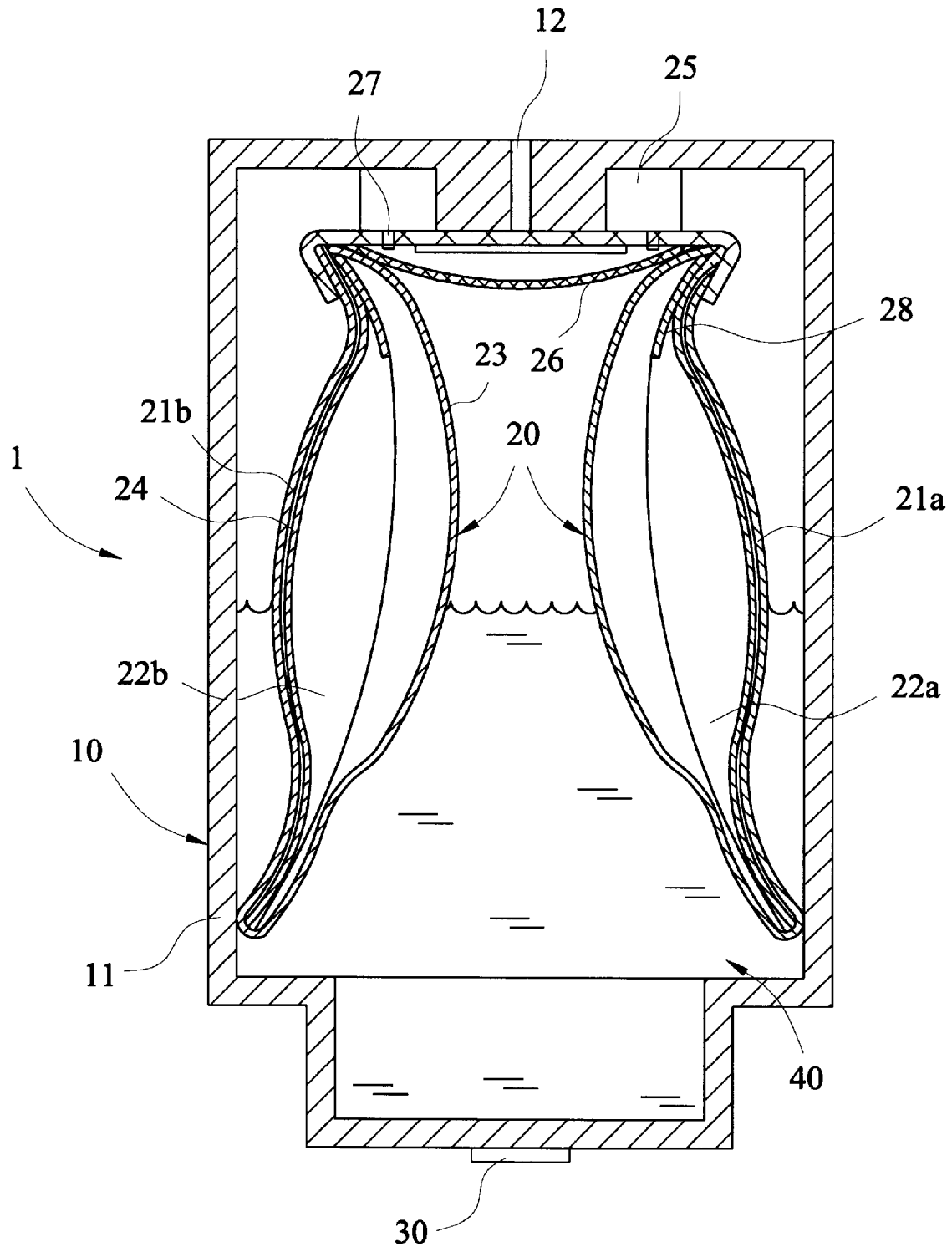
FIG.1(Prior Art)
FIG. 1 is an illustrative diagram of the inflated air bag in the ink jet cartridge of the prior art due to the back pressure increase in the ink reservoir.
Figure 2:
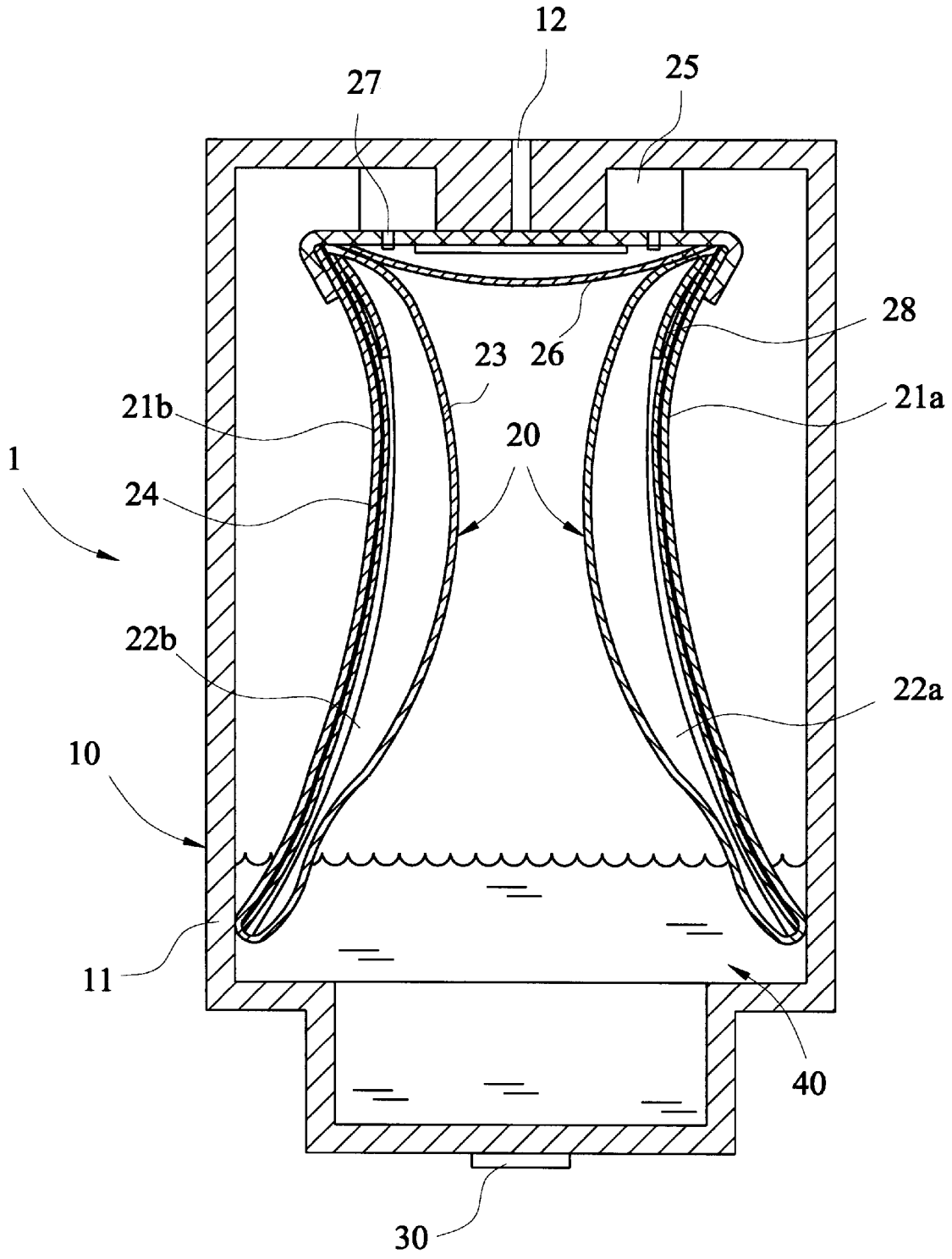
FIG.2(Prior Art)
FIG. 2 is an illustrative diagram of the deflated air bag in the ink jet cartridge of the prior art due to the environmental pressure decrease.
Figure 3:
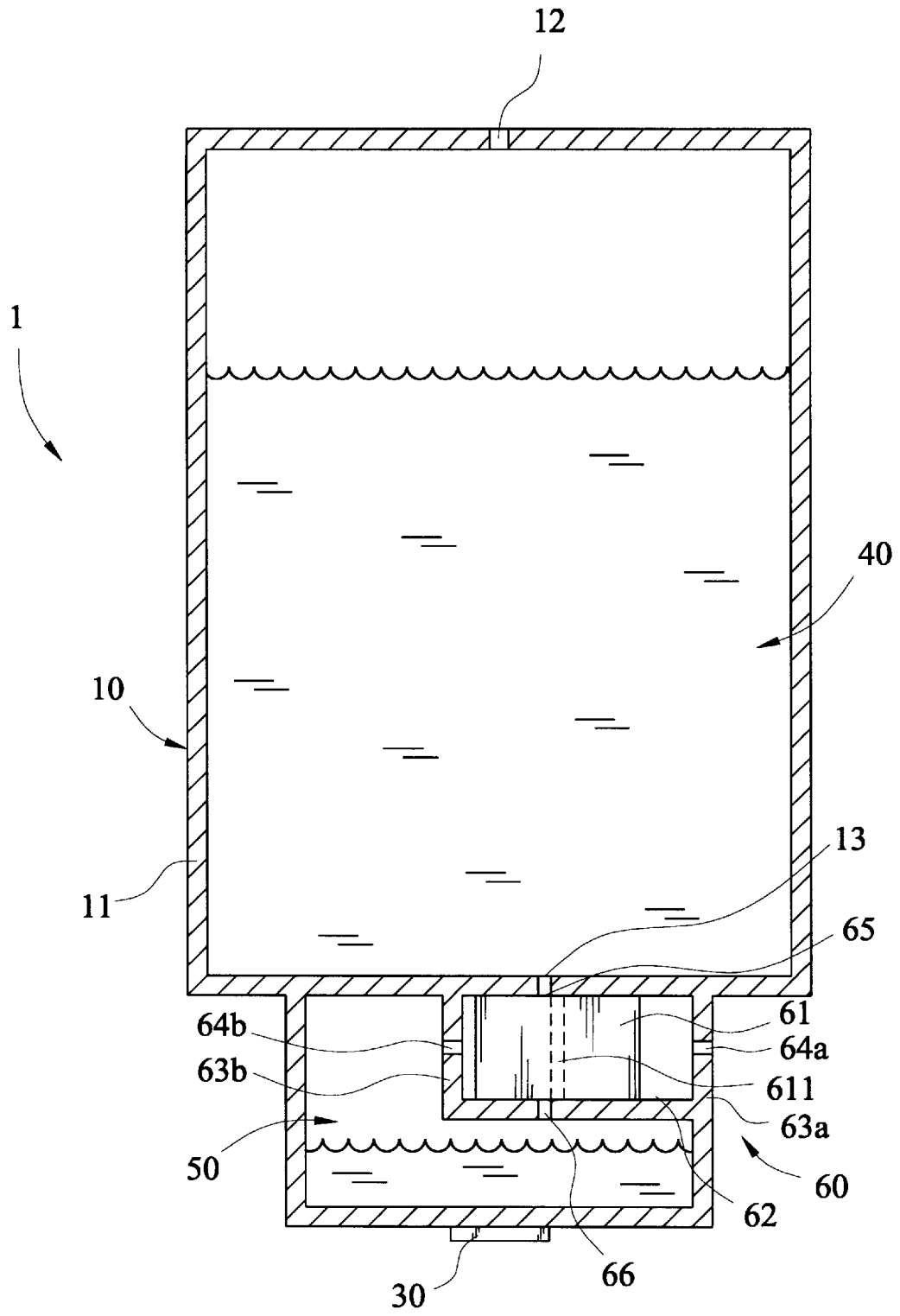
FIG. 3 shows a first embodiment of the ink jet cartridge according to the invention.

Referring to FIG. 3, which shows a structure of the ink jet cartridge 1 with a valve 60 according to the invention. As illustrated, the ink jet cartridge 1 comprises:

an ink reservoir 10, which is a container for storing ink 40 and with at least an orifice 13 for the ink 40 to flow out of, and the container further comprises:

a case 11, which is made of rigid material for storing the ink 40;

a venthole 12, which is at the top of the case 11, allowing the entrance of the environmental air to adjust the pressure in the ink reservoir 10, wherein the venthole 12 can be a simple tiny hole or a tiny hole covered with a one-way dialytic membrane, whose nature of allowing the one-way pass of the air prevents the ink 40 from passing through the one-way dialytic membrane to the environment when there is no pressure change;

an ink chamber 50, which, under the normal condition, is a closed container that connects to the ink reservoir 10 for temporary storage of the ink 40 coming out of the ink reservoir 10 and for ejecting out the temporarily stored ink 40 using the print head 30;

a print head 30, which is sitting at the bottom of the ink chamber 50 for ejecting out the temporarily stored ink 40 in the ink chamber 50 to proceed the printing operation, wherein the print head contains a nozzle that ejects the ink 40 out of the print head 30 using the means of exerting external pressure to push the ink 40 (e.g, by a piezoelectric element) or the means of external heating to vaporize the ink 40 (e.g, by the heat bubble method); and a valve 60, which is connected between the ink reservoir 10 and the ink chamber 50 and comprising:

a plunger chamber 62, which has: an atmospheric opening 64*a* connecting to the atmosphere, an ink inlet 65 connecting to the orifice 13 of the ink reservoir 10, an ink outlet 66 connecting to the ink chamber 50, and a feedback opening 64*b* connecting to the chamber 50; and a plunger 61, which is placed between the atmospheric opening 64*a* and the feedback opening 64*b* within the plunger chamber 62 to cover the ink inlet 65 and the ink outlet 66 and is pushed by the pressure difference between the environmental atmosphere and the ink chamber 50 to control the connection between the ink reservoir 10 an d the ink chamber 50; where in the plunger 61 further comprises a channel 611, through whose connection between the ink inlet 65 and the ink outlet 66 the ink 40 can flow from the ink reservoir 10 into the ink chamber 50; and an environmental plate 63*a* and an ink chamber plate 63*b*, which are installed on both sides of the plunger chamber 62, respectively, with the ink chamber plate 63*b* closer to the ink chamber 50 while the environmental plate 63*a* closer to the environment, and whose main purpose is to prevent the plunger 61 from falling into the environment or the ink chamber 50 while it is moving.

Moreover, the plunger 61 can be of a cylindrical or cubic shape and the plunger chamber 62 is designed according to the shape of the plunger 61 to be a passageway with a circular or square cross section. When printing, the ink reservoir 10 supplies the ink 40. When supplying the ink 40, the channel 611 of the plunger 61 aligns with the orifice 13 of the ink reservoir 10 and the ink 40 flows into the ink chamber 50 via the orifice 13 and the channel 611. The ink 40 in the ink chamber 50 is for the printing use of the print head 30. In the diagram, the position of the valve 60 is the initial position, which is also the manufacturer's initial position setting. The channel 611 of the plunger 61 does not align with the orifice 13 of the ink reservoir 10, and is closer to the side of the environmental plate 63*a*. The plunger 61 completely covers the orifice 13 so that the ink 40 can not flow from the ink reservoir 10 into the ink chamber 50.

Figure 4:
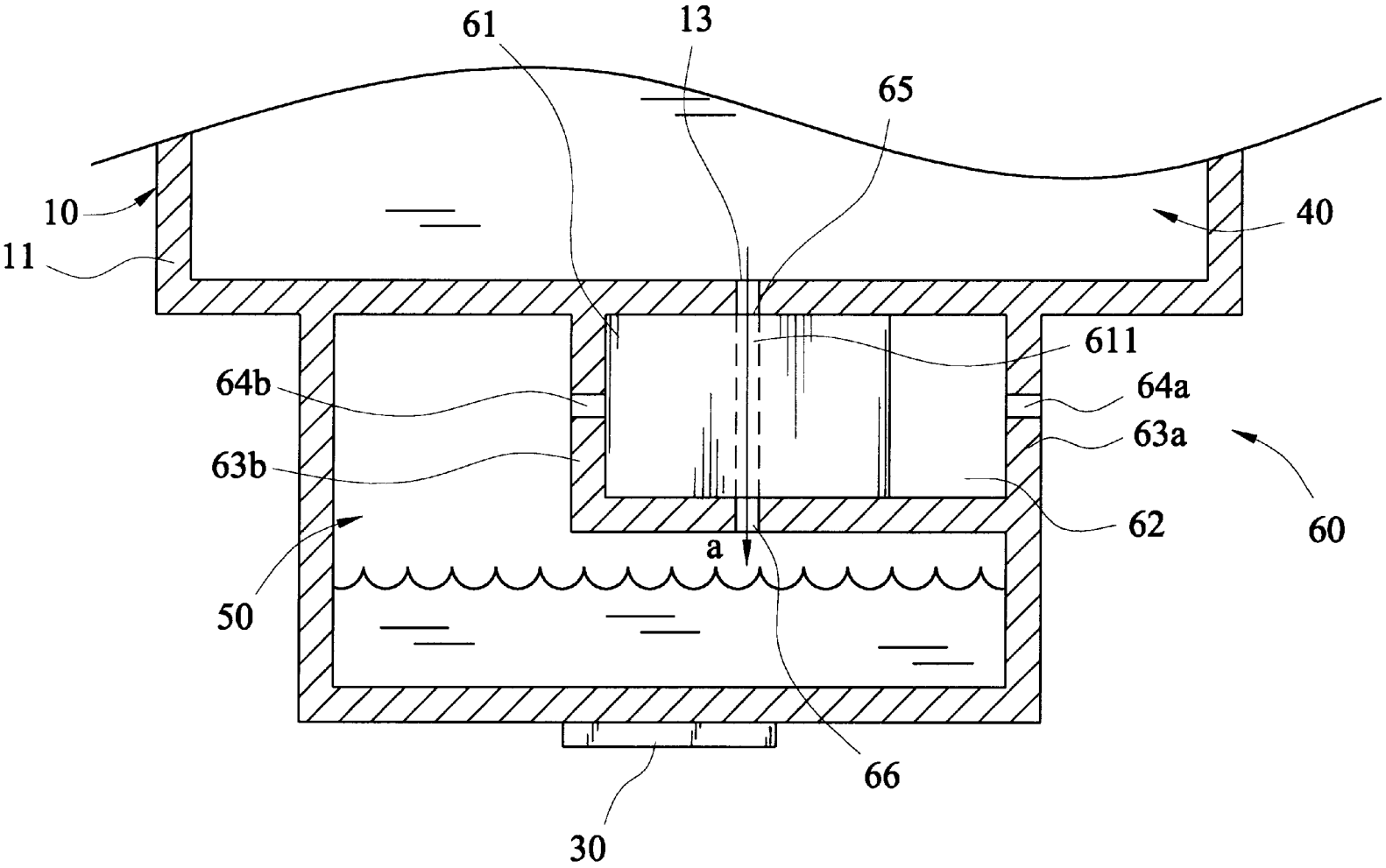
FIG. 4 shows the ink supply of the ink jet cartridge according to the invention.

Referring to FIG. 4, which shows the ink supply of the ink jet cartridge according to the invention. When the channel 611 of the plunger 61 aligns with the orifice 13 of the ink reservoir 10, the ink 40 starts to flow from the ink reservoir 10 into the ink chamber 50 via the channel 611, and the path is shown with an 'a' in the diagram.

Figure 5:
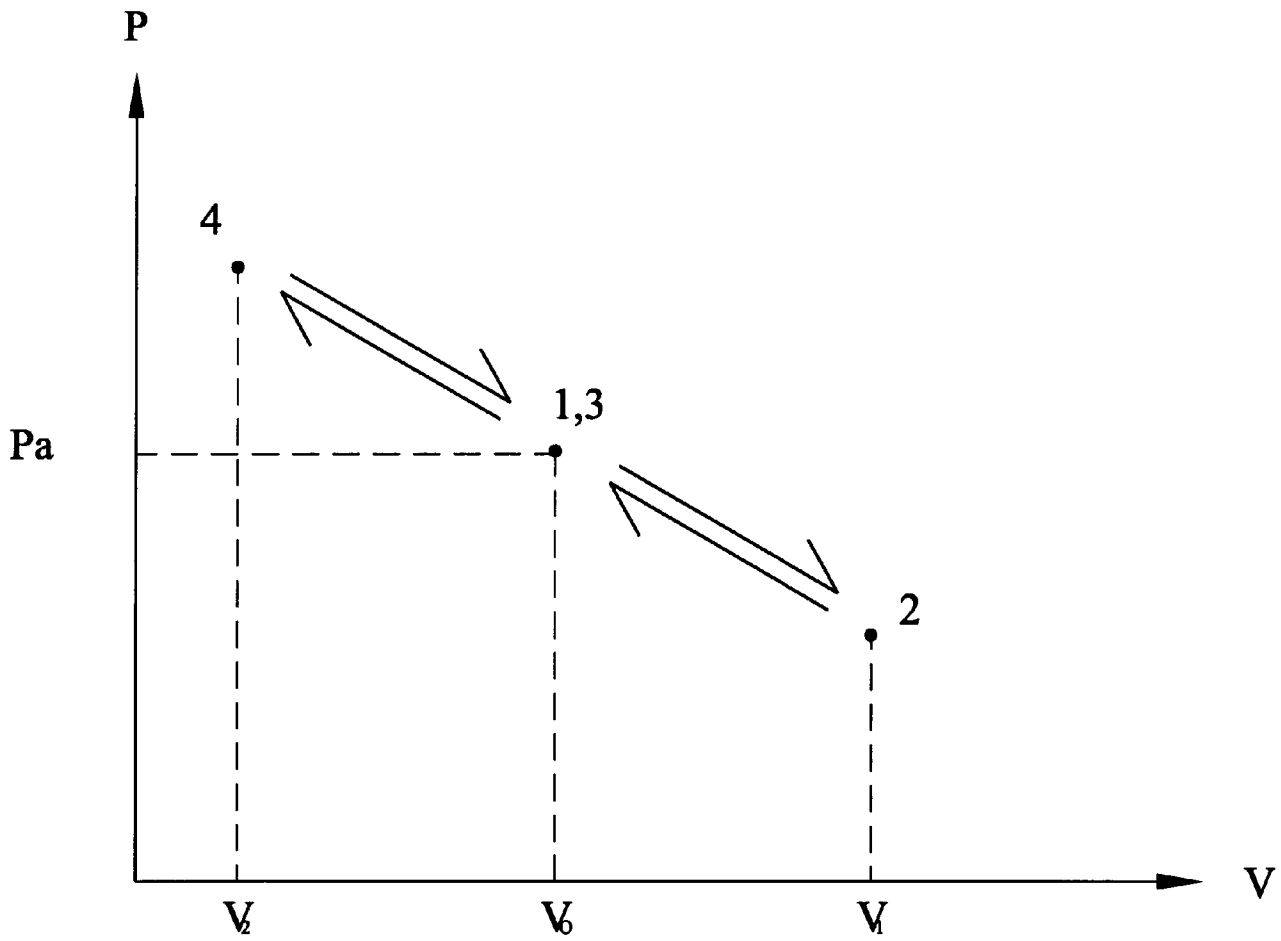
FIG. 5 is a P-V diagram of an embodiment of the ink jet cartridge according to the invention.

Referring to FIG. 5, which is a P-V diagram of an embodiment of the ink jet cartridge according to the invention, where P is the air pressure in the ink chamber 50, V is the air volume in the ink chamber 50, and Pa stands for the environmental air pressure which can be considered as a constant under the normal uses.

The action principle of the valve 60 is:

1. Initial position. This is the status of the initial settings, wherein the air pressure P in the ink chamber 50 is set equal to the environmental air pressure Pa and the air volume in the ink chamber 50 is V0 (the first point in FIG. 5).
2. Starting ink jet. The print head 30 starts to function and the ink 40 in the ink chamber 50 is ejected out by the print head 30. The volume of the ink 40 in the ink chamber 50 gradually decreases and, therefore, the air pressure P in the ink chamber 50 also gets lower (that is, the back pressure increases). At this moment, the air pressure P in the ink chamber 50 is smaller than the environmental air pressure Pa, and the air volume V1 in the ink chamber 50 is greater than V0 (the second point in FIG. 5).
3. Starting ink supply. When the air pressure P in the ink chamber 50 is smaller than the environmental air pressure Pa, the environmental air will push the plunger 61 along the plunger chamber 62 toward the side of the ink chamber plate 63*b* to balance the pressure. When the channel 611 of the plunger 61 aligns with the orifice 13 of the ink reservoir 10, the ink starts to flow from the ink reservoir through the channel 611 into the ink chamber 50. Then the air pressure P in the ink chamber 50 equals the environmental air pressure Pa, and the air volume in the ink chamber 50 goes back to V0 (the third point in FIG. 5, the same as the status of the first point). During continuous ink jet the amount of the ejected ink equals the amount that is entering the ink chamber 50, thus the pressure can be kept balanced while continuous ink printing.
4. Finishing ink jet. When the print head 30 stops ink jet or intermittently jets ink, the channel 611 of the plunger 61 still aligns with the orifice 13 of the ink reservoir 10. The ink supply keeps going on while the air volume V in the ink chamber 50 gradually decreases. Therefore, the air pressure P in the ink chamber 50 steadily increases (that is, the back pressure decreases) until it is greater then the environmental air pressure Pa. At this moment, the air volume V2 in the ink chamber 50 is smaller than V0 (the fourth point in FIG. 5). To regain the pressure balance, the air in the ink chamber 50 pushes the plunger 61 along the plunger chamber 62 toward the side of the environmental plate 63*a* so that the plunger 61 completely covers the orifice 13 and the ink 40 stops flowing from the ink reservoir 10 to the ink chamber 50. Then the air pressure in the ink chamber 50 equals the environmental air pressure Pa and reaches the balanced status. Again, the air volume in the ink chamber 50 goes back to V0, i.e., the initial position (the first point in FIG. 5).

Therefore, while ink jet, the action principle of the valve follows the first, second, third, fourth points and goes back to the first point in FIG. 5 in a cyclic way.

If the ink 40 runs out, as at t he third point status in FIG. 5, the channel 611 of the plunger 61 aligns with the orifice 13 of the ink reservoir 10 and the rest ink 40 completely enters the ink chamber 50 from the ink reservoir 10 via the channel 611. At this moment, the air pressure P in the ink chamber 50 still equals the environmental air pressure Pa and the air volume in the ink chamber 50 is V0. If the print head 30 still jets ink and thus makes the air volume V greater than V0, the air in the ink reservoir 10 will enter the ink chamber 50 via the channel 611. Therefore, the ink 40 can completely runs out without the defect of wasting ink.

Figure 6:
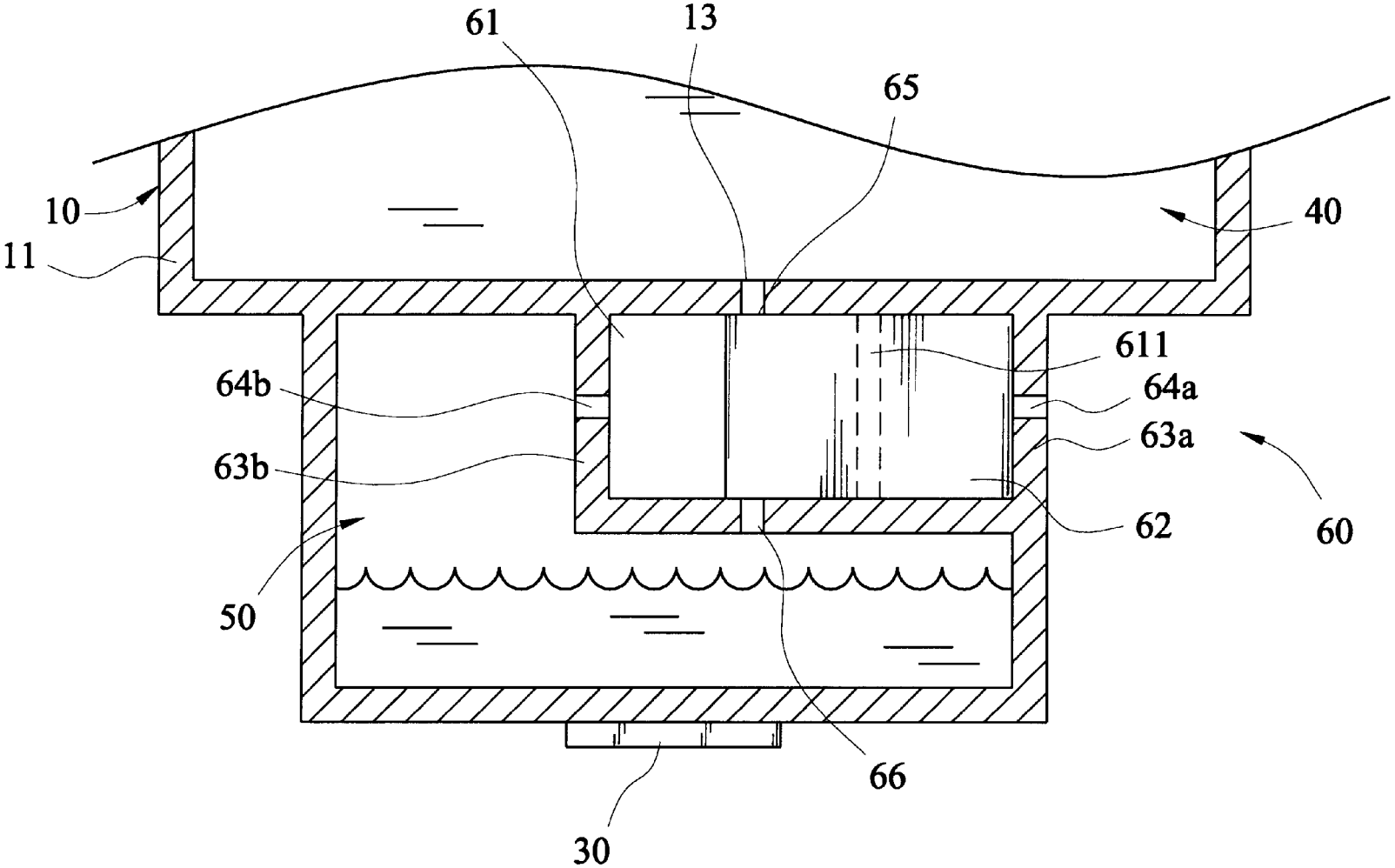
FIG. 6 is a diagram showing the position of the valve of the ink jet cartridge according to the invention while the environmental pressure decreases.

Referring to FIG. 6, which is a diagram showing the position of the valve 60 of the ink jet cartridge 1 according to the invention while the environmental pressure decreases. When the environmental pressure decreases (such as in an airfreight), the air pressure in the ink chamber 50 is greater than the environmental pressure and will likely squeeze the ink 40 out of the print head 30. To keep the pressure balanced, the air in the ink chamber 50 pushes the plunger 61 along the plunger chamber 62 toward the environmental plate 63*a* until the plunger 61 hits the environmental plate 63*a*. Now the pressure is balanced and the plunger 61 completely covers the orifice 13 of the ink reservoir 10 so that the ink 40 cannot flow out of the ink reservoir 10 and thus there will be no ink leakage.

Embodiment 2

Figure 7:
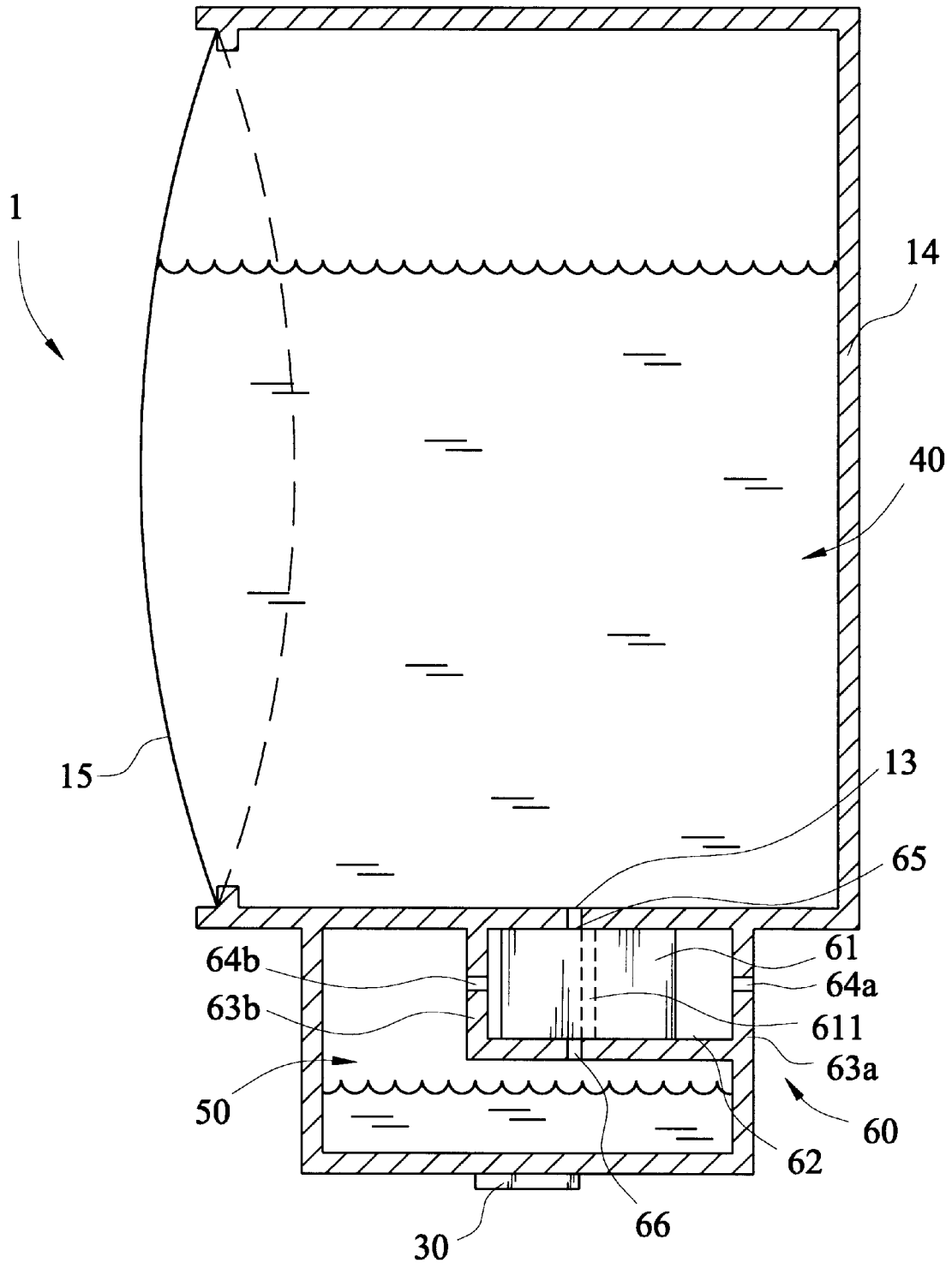
FIG. 7 shows a second embodiment of the ink jet cartridge according to the invention.

Further, referring to FIG. 7, which shows a second embodiment of the ink jet cartridge according to the invention. As shown in the diagram, the ink jet cartridge 1 comprises:

- an ink reservoir 10 comprising:
  - a rigid structure 14, which is the structure for storing the ink 40 and has a side opening; and
  - a membranous plate 15, which is made of membranous material and directly connected to the opening on the rigid structure 14, wherein as the pressure in the ink reservoir 10 gets lower, the membranous plate 15 deforms and presses into the ink reservoir 10 so that the ink reservoir can continue ink supply;
- a print head 30;
- an ink chamber 50;
- a valve 60, comprising:
  - a plunger 61 with a channel 611; and
  - a plunger chamber 62; and
- an environmental plate 63*a* and an ink chamber plate 63*b*.

In particular, the ink reservoir 10 is composed of the rigid structure 14 and the membranous plate 15. When the ink 40 in the ink reservoir 10 flows into the ink chamber 50 via the orifice 13, the amount of ink in the ink reservoir 10 decreases. Thus, the back pressure increases, that is, the inner pressure of the ink reservoir 10 is smaller than the environmental pressure. To conquer the back pressure and allow the ink 40 flow into the ink chamber 50, the membranous plate 15 will be pressed by the environmental atmosphere and decrease the air volume in the ink reservoir 10 to balance the pressure and continue supplying the ink 40.

Embodiment 3

Figure 8:
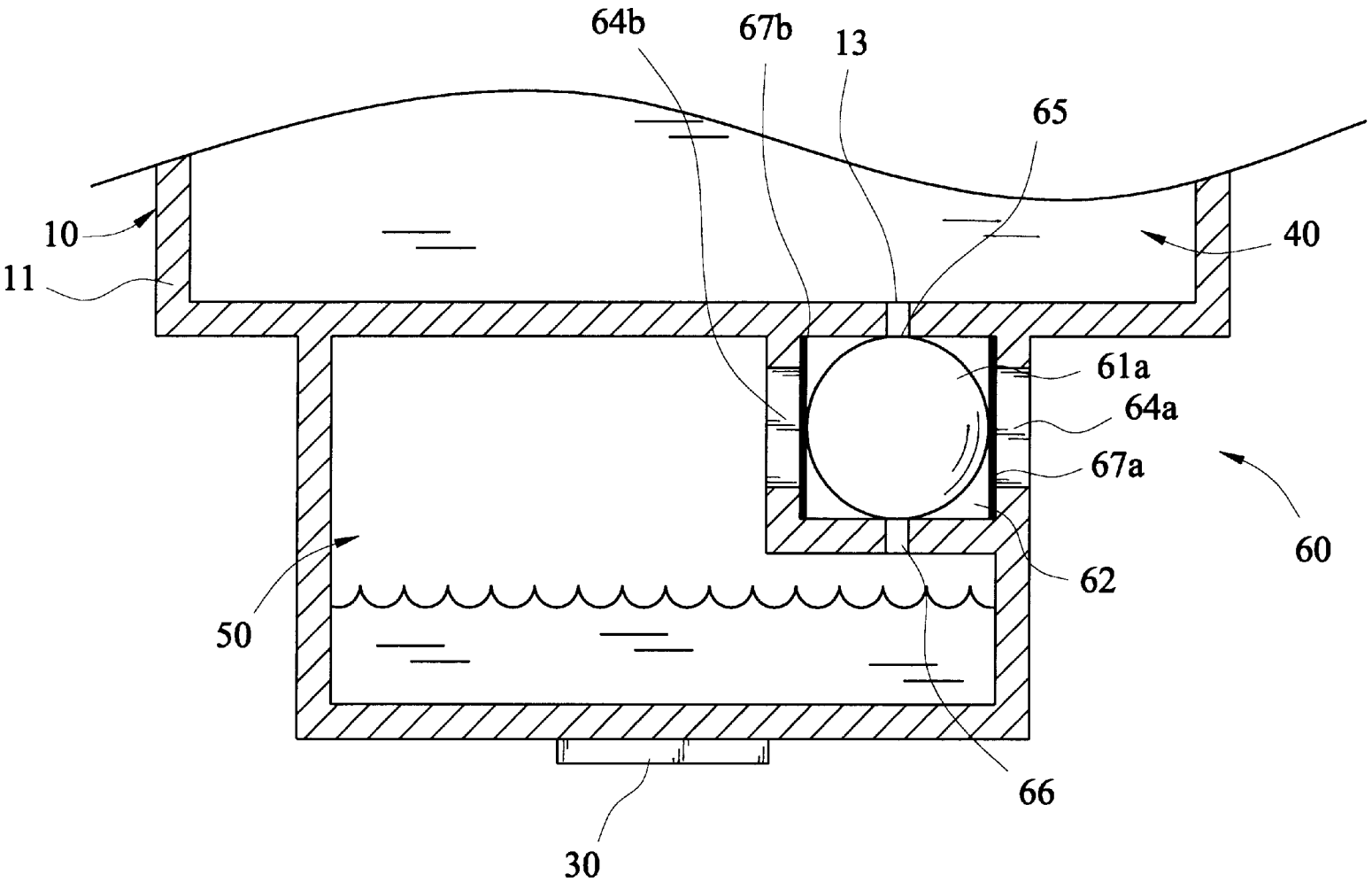
FIG. 8 is a diagram of another structure of the valve according to the invention.

Referring to FIG. 8, which is a diagram of another structure of the valve according to the invention. As shown in the diagram, the valve 60 comprises:

a plunger chamber 62, comprising: an atmospheric opening 64*a* connecting to the atmosphere, an ink inlet 65 connecting to the orifice 13 of the ink reservoir 10, an ink outlet 66 connecting to the ink chamber 50, and a feedback opening 64*b* connecting to the ink chamber 50;

a ball 61*a*, which is placed between the atmospheric opening 64*a* and the feedback opening 64*b* within the plunger chamber 62 to cover the ink inlet 65 and the ink outlet 66, wherein the ball 61*a* is moved by the pressure difference between the environmental atmosphere and the ink chamber 50 to determine whether the ink reservoir 10 is connected to the ink chamber 50 or not; and an environmental thin membrane 67*a* and an ink chamber membrane 67*b*, which are installed on the atmospheric opening 64*a* and the feedback opening 64*b* of the plunger chamber 62, respectively, with the ink chamber membrane 67*b* closer to the ink chamber 50 and the environmental membrane 67*a* closer to the environment; wherein when a pressure difference between the atmosphere and the ink chamber 50 develops, the membranes 67*a*, 67*b* will inflate and indirectly push the ball 61*a* along the ink chamber 62 as well as prevent the ball 61*a* from falling into the environment or the ink chamber 50 while sliding.

Figure 9:
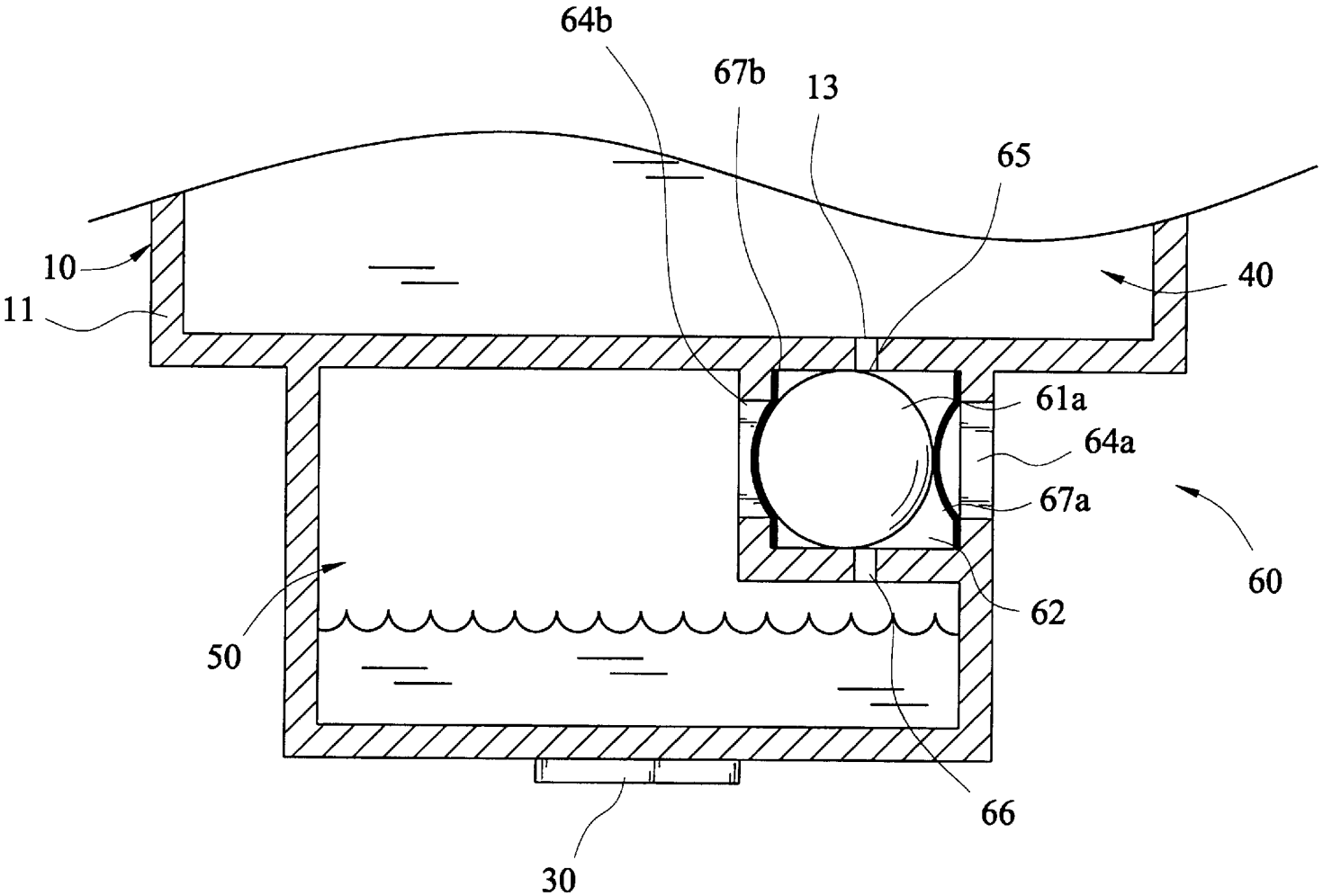
FIG. 9 illustrates the ink supply of the valve in FIG. 8.

The action principle of the ball 61*a* is almost the same as the plunger 61 of the valve 60 in the first embodiment, except:

1. At the initial position (as shown in FIG. 8), it is the ball 61*a* that aligns with the orifice 13 of the ink reservoir 10 and completely covers the orifice 13 so that the ink 40 cannot flow from the ink reservoir 10 into the ink chamber 50.
2. While ink supply (as shown in FIG. 9), the air pressure in the ink chamber 50 is smaller than the environmental air pressure and the environmental membrane 67*a* will push the ball 61*a* toward the ink chamber membrane 67*b* to balance the pressure. The ball 61*a* then does not cover the orifice 13 any more and the ink 40 starts to flow from the ink reservoir 10 into the ink chamber 50, and the air pressure in the ink chamber equals the atmospheric pressure to ensure the continuous ink supply and pressure balance.

A valve of the ink jet cartridge according to the present invention has the following merits:

1. It is used as the ink supply controller between the ink reservoir and the ink chamber of the ink jet cartridge for adjusting the ink flow from the ink reservoir to the ink chamber. It can also balance the pressure between the ink chamber and the environment for proper ink supply and better printing without any variation in the ink droplet size;
2. It can keep the pressure in the ink chamber within the allowed range as the ink is gradually depleted and continue printing until the ink totally runs out without any ink waste;
3. It also maintains a balanced pressure while there is any change in the environment, such as the environmental pressure rise or fall, and the plunger completely covers the orifice of the ink reservoir so that the ink can not flow out of the ink reservoir to achieve the goal of no ink leakage.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet cartridge for storing ink and printing the ink, which comprises:

an ink reservoir, which is a container for storing the ink and has at least one orifice for the ink to flow out through the orifice;

an ink chamber, which is a closed container under normal condition and is connected to the ink reservoir for temporary storage of the ink flowing out of the ink reservoir;

a print head, which is placed at the bottom of the ink chamber to jet the ink in the ink chamber for printing;

a valve which is connected between the ink reservoir and the ink chamber and includes:

a plunger chamber, which has an atmospheric opening connecting to the atmosphere, an ink inlet connecting to the orifice of the ink reservoir, an ink outlet connecting to the ink chamber, and a feedback opening connecting to the ink chamber; and a plunger, which is placed between the atmospheric opening and the feedback opening within the plunger chamber to cover the ink inlet and the ink outlet, is moved by a pressure difference between the atmosphere and the ink chamber to control whether the ink reservoir is connected to the ink chamber or not.

2. An ink jet cartridge of claim 1, wherein the ink reservoir further comprises:

a case, which is mainly used as a structure for storing the ink and is made of rigid material; and a venthole, which is at the top of the case for the entrance of environmental air to achieve the goal of adjusting pressure in the ink reservoir.

3. An ink jet cartridge of claim 2, wherein the venthole has a one-way dialytic membrane, which allows the one-way pass of the air so that the ink can not pass through the one-way dialytic membrane to the environment when there is no pressure change.

4. An ink jet cartridge of claim 1, wherein the ink reservoir further comprises:

a rigid structure, which is mainly used as a structure for storing the ink and has a side opening; and a membranous plate, which is made of membranous material and directly connected to the opening on the rigid structure, wherein when the pressure in the ink reservoir gets lower, the membranous plate deforms and presses into the ink reservoir so that the ink reservoir continues ink supply.

5. An ink jet cartridge of claim 1, wherein the ink chamber is under the ink reservoir for temporary storage of the ink flowing out of the ink reservoir.

6. An ink jet cartridge of claim 1, wherein the plunger is of a cylindrical shape and the plunger chamber is designed according to the shape of the plunger as a circular passageway.

7. An ink jet cartridge of claim 1, wherein the plunger of the valve contains a channel by which the ink inlet and the ink outlet are connected so that the ink flows from the ink reservoir into the ink chamber.

8. An ink jet cartridge of claim 7, wherein when the atmospheric pressure is greater than the inner pressure of the ink chamber the plunger is pushed by the atmospheric pressure so that the channel of the plunger aligns with the ink inlet and the ink outlet for the ink to flow from the ink reservoir into the ink chamber, while when the atmospheric pressure is smaller than the inner pressure of the ink chamber the plunger is pushed by the inner pressure of the ink chamber so that the plunger covers the ink inlet and the ink outlet preventing the ink from flowing from the ink reservoir into the ink chamber.

9. An ink jet cartridge of claim 1, wherein the atmospheric opening and the feedback opening of the plunger chamber are covered with an environmental membrane and an ink chamber membrane, respectively, for indirectly moving the plunger within the plunger chamber as a pressure difference between the atmosphere and the ink chamber develops.

10. An ink jet cartridge of claim 1, wherein the plunger of the valve is a ball, which is used to forbid the ink to flow from the ink reservoir into the ink chamber.

11. An ink jet cartridge of claim 10, wherein the atmospheric opening and the feedback opening of the plunger chamber are covered with an environmental membrane and an ink chamber membrane, respectively, for indirectly moving the ball within the plunger chamber as a pressure difference between the atmosphere and the ink chamber develops.

12. An ink jet cartridge of claim 1, wherein a piezoelectric element is used in the print head to push the ink for jetting the ink.

13. An ink jet cartridge of claim 1, wherein a bubble heat method is used in the print head to vaporize the ink for jetting the ink.

14. A valve used in an ink jet cartridge, which is connected between an ink reservoir and an ink chamber of the ink jet cartridge for controlling whether the ink stored in the ink reservoir flows into the ink chamber and comprises:

a plunger chamber, which has an atmospheric opening connecting to the atmosphere, an ink inlet connecting to the orifice of the ink reservoir, an ink outlet connecting to the ink chamber, and a feedback opening connecting to the ink chamber; and a plunger, which is placed between the atmospheric opening and the feedback opening within the plunger chamber to cover the ink inlet and the ink outlet, is moved by pressure difference between the atmosphere and a ink chamber to control whether the ink reservoir is connected to the ink chamber or not.

15. A valve of claim 14, wherein the plunger is of a cylindrical shape and the plunger chamber is designed according to the shape of the plunger as a circular passageway.

16. A valve of claim 14, wherein the plunger of the valve contains a channel by which the ink inlet and the ink outlet are connected so that the ink flows from the ink reservoir into the ink chamber.

17. A valve of claim 16, wherein when the atmospheric pressure is greater than the inner pressure of the ink chamber the plunger will be pushed by the atmospheric pressure so that the channel of the plunger aligns with the ink inlet and the ink outlet for the ink to flow from the ink reservoir into the ink chamber, while when the atmospheric pressure is smaller than the inner pressure of the ink chamber the plunger will be pushed by the inner pressure of the ink chamber so that the plunger covers the ink inlet and the ink outlet preventing the ink from flowing from the ink reservoir into the ink chamber.

18. A valve of claim 14, wherein the atmospheric opening and the feedback opening of the plunger chamber are covered with an environmental membrane and an ink chamber membrane, respectively, for indirectly moving the plunger within the plunger chamber as a pressure difference between the atmosphere and the ink chamber develops.

19. A valve of claim 14, wherein the plunger of the valve is a ball, which is used to forbid the ink to flow from the ink reservoir into the ink chamber.

20. A valve of claim 19, wherein the atmospheric opening and the feedback opening of the plunger chamber are covered with an environmental membrane and an ink chamber membrane, respectively, for indirectly moving the ball within the plunger chamber as a pressure difference between the atmosphere and the ink chamber develops.

* * * * *